US008523523B2

(12) United States Patent
Townes et al.

(10) Patent No.: US 8,523,523 B2
(45) Date of Patent: Sep. 3, 2013

(54) COOLING ARRANGEMENTS

(75) Inventors: Roderick M. Townes, Derby (GB); Ian Tibbott, Lichfield (GB); Edwin Dane, Nottingham (GB); Caner H. Helvaci, Derby (GB)

(73) Assignee: Rolls-Royce PLC, London (GB)

( * ) Notice: Subject to any disclaimer, the term of this patent is extended or adjusted under 35 U.S.C. 154(b) by 527 days.

(21) Appl. No.: 12/787,758

(22) Filed: May 26, 2010

(65) Prior Publication Data

US 2010/0303635 A1 Dec. 2, 2010

(30) Foreign Application Priority Data

Jun. 1, 2009 (GB) ..... 0909255.2

(51) Int. Cl.
*F01D 5/08* (2006.01)
*F01D 5/20* (2006.01)

(52) U.S. Cl.
USPC ..... 416/90 R; 416/97 R

(58) Field of Classification Search
USPC ..... 415/115; 416/90 R, 96 R, 97 R
See application file for complete search history.

(56) References Cited

U.S. PATENT DOCUMENTS

| | | | | |
|---|---|---|---|---|
| 6,406,260 | B1 * | 6/2002 | Trindade et al. | 416/96 R |
| 6,837,683 | B2 * | 1/2005 | Dailey | 416/97 R |
| 8,052,389 | B2 * | 11/2011 | Kopmels | 416/96 R |
| 2009/0087312 | A1 | 4/2009 | Bunker et al. | |

FOREIGN PATENT DOCUMENTS

| | | | |
|---|---|---|---|
| EP | 1 197 636 | A3 | 12/2003 |
| EP | 1 630 353 | A2 | 3/2006 |
| EP | 1 873 354 | A2 | 1/2008 |
| WO | WO 01/31170 | A1 | 5/2001 |

OTHER PUBLICATIONS

British Search Report issued in corresponding British Application No, GB090255.2, dated Sep. 21, 2009.

* cited by examiner

*Primary Examiner* — Edward Look
*Assistant Examiner* — Christopher J Hargitt
(74) *Attorney, Agent, or Firm* — Oliff & Berridge, PLC

(57) ABSTRACT

Providing cooling within hollow blades such as high pressure turbine blades in a gas turbine engine is important to maintain these components within operational margins for the materials from which they are formed. Traditionally, coolant flows in hollow passages have been used along with impingement apertures towards a leading passage for cooling effectiveness. It is known that opposed undulations or ribs can create rotational vortices within the passage. By shaping shaped portions between the opposed undulations and possibly providing undulations upon these shaped portions themselves it is possible to generate stronger more powerful vortices within the passage. These vortices are coupled with the impingement orifices to create proportionally greater impingement jet flow and pressure and therefore cooling effectiveness within the leading passage.

11 Claims, 5 Drawing Sheets

COOLING ARRANGEMENTS

BACKGROUND

The present invention relates to cooling arrangements and more particularly to cooling arrangements in blades such as high pressure turbine blades in a gas turbine engine.

With high pressure turbine blades within gas turbine engines it will be appreciated that the relatively high temperatures to which the blades are subjected necessitate cooling in order that the materials from which such components are made can remain within the operational capabilities of those materials. Other components within a gas turbine engine which must be able to withstand such high temperatures and other operational requirements include nozzle guide vanes. Traditionally two approaches have been taken with regard to achieving necessary cooling. Firstly, impingement cooling is achieved through providing passages which extend along the length of the blade or other component with a coolant fluid under pressure, which then is projected through impingement orifices from the passage to a chamber beneath the surface to be cooled. In such circumstances, coolant fluid is projected towards that surface at high velocity, generating high heat transfer, thereby coking that part of the component. An alternative is simply provision of radial channels which are presented below the surface of the component. Each approach has its advantages and disadvantages. Impingement cooling generally gives significantly increased heat transfer compared to radial cooling even where ribs are utilised to create turbulence, but the necessity for impingement orifices greatly increases manufacturing complexity, cost and may reduce fatigue life.

SUMMARY

It will be appreciated that the leading edge of a turbine blade has a high external heat flux and in such circumstances requires significant amounts of film cooling to protect against oxidation and fatigue damage. Furthermore in situations where a thermal barrier coating is used such locations are also vulnerable to the coating being lost through foreign object damage or over temperature of the coating and/or its bond coat which can further shorten operational life. Through use of appropriate cooling technology, improvements can be made which reduce the leading edge temperature, but a balance must be struck between reducing cooling air consumption and allowing an increase in the temperature at which the engine operates which in turn will affect overall engine performance in terms of efficiency and reduced fuel burn.

According to aspects of the present invention there is provided a cooling arrangement for a hollow blade, the arrangement comprising a passage for a fluid flow therealong, opposed undulations provided in the passage to engage the fluid flow in use to generate a lateral or rotating vortex flow aspect in the fluid flow and a shaped portion of the passage between the opposed undulations shaped to divide the vortex flow aspect into a number of vortices.

Typically, the shaped portion of the passage is angular. Generally, the undulations are ribs or turbulators.

Possibly, the shaped portion includes undulations to facilitate vortex development.

Possibly, the passage has an adjacent wall containing impingement orifices opposite the shaped portion, these impingement orifices connect to a further passage. Typically, the orifice portion is also shaped to facilitate vortex development in the passage.

Possibly, the orifice portion divides the passage from a leading passage in a hollow blade.

Generally, the orifices of the orifice portion are directed to project at least a proportion of the fluid flow towards an opposed portion of the leading passage.

Generally, the shaped portion is arranged in the passage whereby the vortices are substantially constrained within their respective portion of the passage.

Also in accordance with aspects of the present invention there is provided a blade incorporating a cooling arrangement as described above. Typically, the blade is a high pressure turbine blade for a gas turbine engine.

BRIEF DESCRIPTION OF THE DRAWINGS

Embodiments of aspects of the present invention will now be described by way of example only with reference to the accompanying drawings in which.

DETAILED DESCRIPTION OF THE EMBODIMENTS

Figure 1:
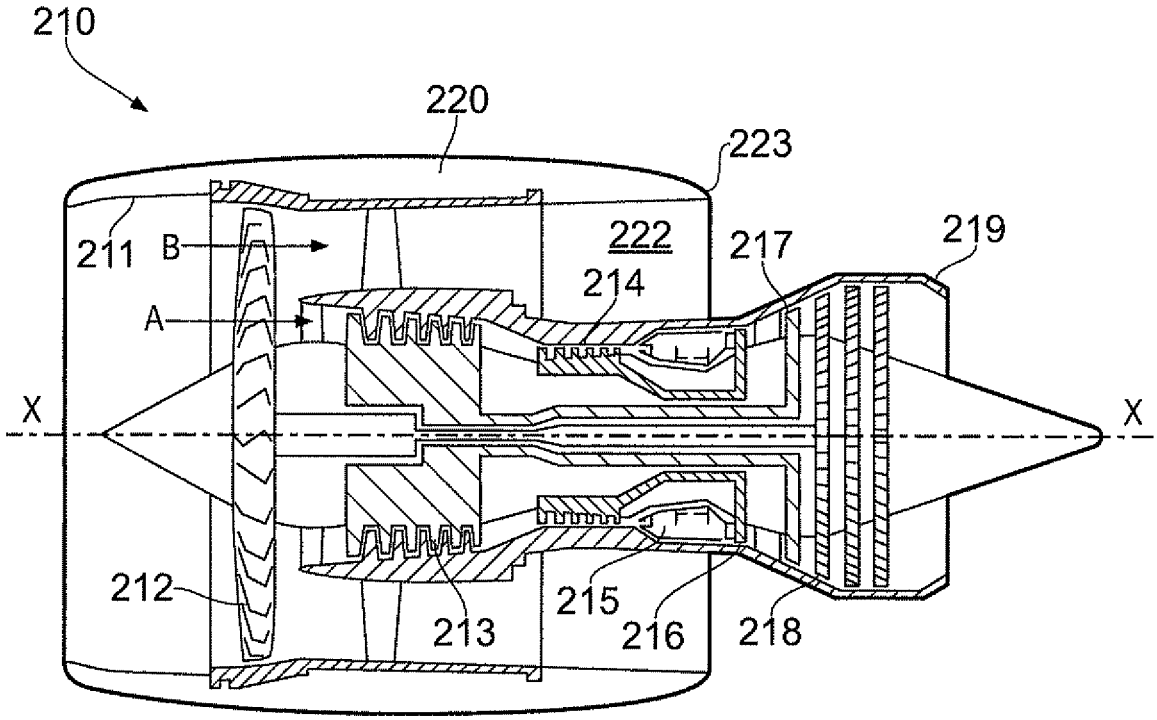
FIG. 1 is a schematic section through a conventional gas turbine engine in which a blade in accordance with the present invention may be used.

With reference to FIG. 1, a ducted fan gas turbine engine generally indicated at 210 has a principal and rotational axis XX. The engine 210 comprises, in axial flow series, an air intake 211, a propulsive fan 212, an intermediate pressure compressor 213, a high-pressure compressor 214, combustion equipment 215, a high-pressure turbine 216, and intermediate pressure turbine 217, a low-pressure turbine 218 and a core engine exhaust nozzle 219. A nacelle 220 generally surrounds the engine 210 and defines the intake 211, a bypass duct 222 and a bypass exhaust nozzle 223.

The gas turbine engine 210 works in a conventional manner so that air entering the intake 211 is accelerated by the fan 212 to produce two air flows: a first air flow A into the intermediate pressure compressor 213 and a second air flow B which passes through a bypass duct 222 to provide propulsive thrust. The intermediate pressure compressor 213 compresses the air flow directed into it before delivering that air to the high pressure compressor 214 where further compression takes place.

The compressed air exhausted from the high-pressure compressor 214 is directed into the combustion equipment 215 where it is mixed with fuel and the mixture combusted. The resultant hot combustion products then expand through, and thereby drive the high, intermediate and low-pressure turbines 216, 217, 218 before being exhausted through the nozzle 219 to provide additional propulsive thrust. The high, intermediate and low-pressure turbines 216, 217, 218 respectively drive the high and intermediate pressure compressors 214, 213 and the fan 212 by suitable interconnecting shafts.

The compressors and turbines each comprise an annular array of radially extending blades mounted on a rotor disc. Each array of blades may have an annular array of vanes either upstream and/or downstream with respect to the main working fluid passing through the engine. Particularly, the turbine blades and vanes require cooling and the present invention relates to a new cooling arrangement within such a blades and vanes. The present invention may also be applied to compressor blades and vanes.

Figure 2:
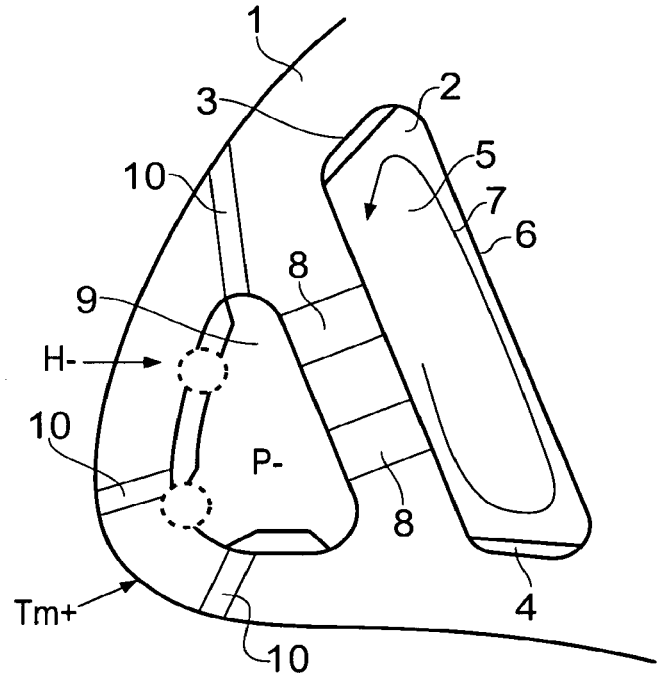
FIG. 2 Prior Art
FIG. 2 is a schematic cross section of a typical prior cooling arrangement.

It is known that carefully positioned radially inclined turbulators or ribs in the form of undulations in opposed parts of a passage through which a fluid flows such as a coolant flow passes can generate a rotating vortex as shown in FIG. 2. This rotating vortex has a substantial lateral aspect, that is to say rotating laterally to the general longitudinal direction of flow perpendicular to and extending out from the page upon which FIG. 2 is depicted. By changing the undulations, that is to say rib orientation it is also known that this can generate potentially dual vortices or secondary flows although not of a strong nature. To be effective to improve impingement cooling effectiveness greater flow force is required. As can be seen in FIG. 2 a component such as a hollow blade 1 has a passage 2 in which opposed parts 3, 4 include undulations to generate a rotating or lateral vortex 5 which rotates generally adjacent walls 6 of the passage 2. The path of the vortex 5 is shown by arrowheads 7.

Fluid flow, that is to say coolant flow from the passage 5 passes through impingement orifices or apertures 8 to project the flow towards a leading passage 9. The leading passage 9 cools a leading edge of the blade 1 and furthermore includes film orifices 10 which create a coolant film upon the surface of the blade 1 about the lead edge such that in addition to the cooling effect H− the excessive high material temperatures Tm+ are separated from the component 1 through the coolant film generated through the orifices 10.

Although provision of the vortex 7 enhances turbulence and projection flow through the impingement orifices 8 it will be understood that this is not ideal. Directionality as well as further turbulence within the effective feed passage 2 would improve overall performance. By aspects of the present invention a number of vortices are created within the feed passages in accordance with aspects of the present invention.

Figure 3:
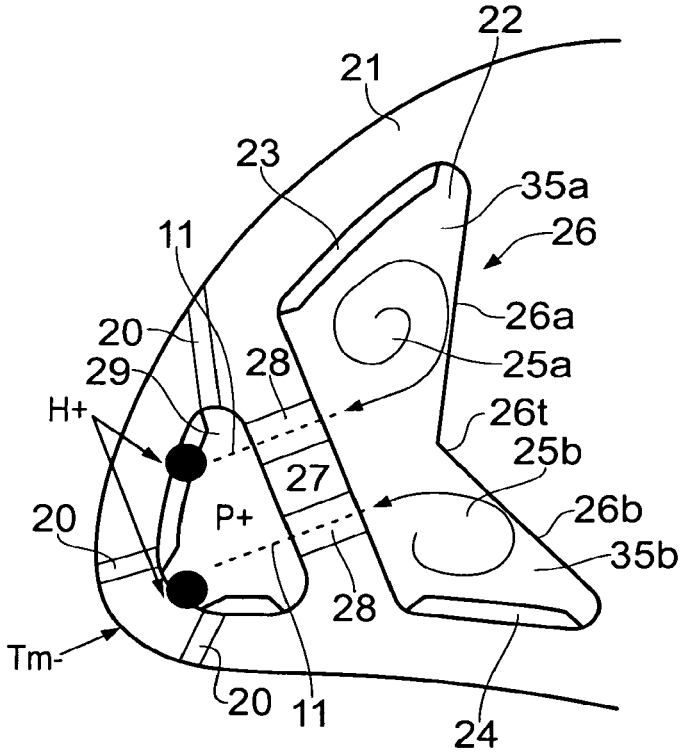
FIG. 3 provides a schematic cross section of a first embodiment of aspects of the present invention.

By shaping walls between the undulations or ribs powerful vortices can be generated. FIG. 3 provides an illustration in which a component in the form of a hollow blade 21 includes a passage 22 having opposed ribs or undulations 23, 24. In such circumstances double vortices 25 are created through a shaped portion 26 in the walls of the passage 22 between the undulations 23, 24. The shaped portion 26 is generally angular in order to provide a division within the passage 22 between the vortices 25*a*, 25*b* to reducing cross flow.

It will be understood advantages with regard to providing double vortices 25 in the passage 22 create benefits with regard to:

a) Increasing the velocity of impingement by jets in the direction of dotted line 11 projected through impingement apertures 28. Increasing the velocity of the jets 11 will increase the dynamic head at the inlet to the impingement hole. Thus an increase in internal heat transfer in the leading edge passage H+ will occur with a reduced metal temperature at the leading edge Tm−.

b) Increasing the total pressure in a lead passage 29 will also allow the feed flow pressure through the passage 22 to be lowered without reducing the edge film pressure margins through the film apertures 20. In such circumstances film cooling is more optimal and there is a reduction in leakages from the blade cooling system.

As the shaping of the shaped portion 26 is constant it will be appreciated that problems with respect to variability during an operational life for a component will not occur and the shaped portion 26 can be created upon forming the blade 21. FIG. 3 provides a schematic cross section of a first embodiment of aspects of the present invention but it will appreciated that other embodiments and variations may be created as described below with respect to other FIGS. 4 to 11. Variations can also be achieved through variations in the undulations 23, 24, the shaped portion 26 and the size and orientation of the impingement apertures 28 projecting the flows 11 towards the opposed parts of the leading passage 29.

Figure 4:
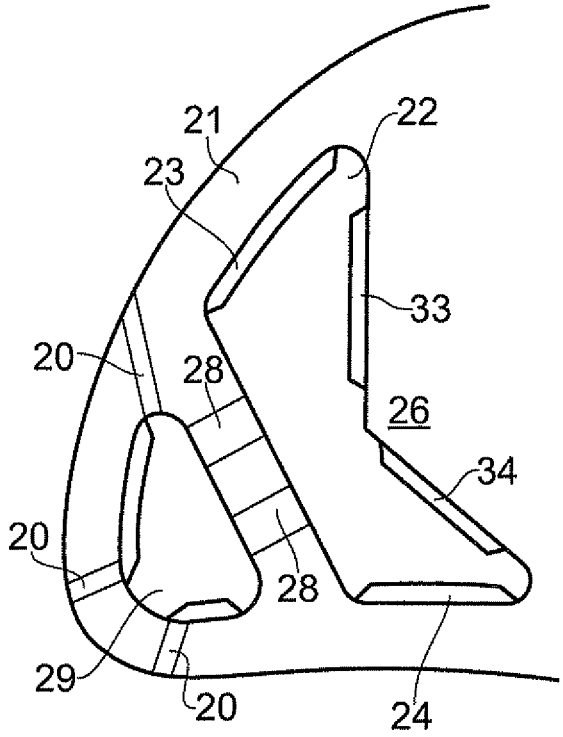
FIG. 4 provides a schematic illustration of a variant of the first embodiment of aspects of the present invention as depicted in FIG. 2 in greater detail.

FIG. 4 provides a further illustration of the embodiment depicted in FIG. 3 with the circulation arrows etc removed to provide greater detail. It will also be noted that the shaped portion 26 includes further undulations 33, 34 to further enhance creation of vortices within the passage 22 in terms of strength and definition. These vortices as indicated before will have a significant lateral aspect in comparison with the flow direction which will generally be perpendicular to the page within which FIG. 4 is depicted and so along the passage 22. In such circumstances as described previously more powerful vortices will be created which will be projected towards the impingement apertures. 28 into the leading passage 29 and therefore generate films through film apertures 22 and impingement cooling by engaging opposed parts to a wall portion within which the impingement apertures 28 are created. It will be understood that provision of undulations 33, 34 in addition to undulations 23, 24 within the confines of the passage 22 may add to manufacturing complexity in comparison with smooth surfaces as depicted in FIG. 3 but will create as indicated stronger vortices and therefore potentially better cooling effects within a hollow blade component 21.

Figure 5:
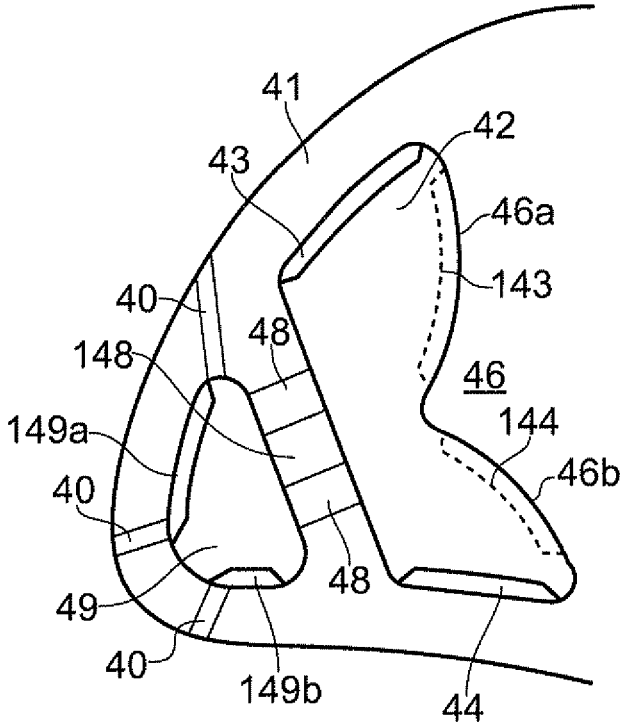
FIG. 5 is a schematic illustration of a second embodiment of aspects of the present invention.

FIG. 5 provides a schematic cross section of a leading part of a hollow component 41 in which a second embodiment of aspects of the present invention is depicted. As previously a passage 42 includes opposed undulations 43, 44 to generate a lateral aspect in a fluid flow, that is to say coolant flow through the passage 42. The coolant flow will pass longitudinally along the passage 42 and the lateral aspect due to the opposed undulations will be enhanced by a shaped portion 46. The shaped portion 46 is curved in comparison with the straight angular depictions as shown in FIG. 3 and FIG. 4. Such curvature may enhance vortex generation. Furthermore as depicted by broken lines 143, 144 further undulations or ribs may be created in the shaped portion 46 to enhance vortex creation. As previously an impingement wall portion 148 includes impingement orifices or apertures 48. The impingement orifices 48 project coolant flow generated in the vortices in the passage 42 into and within a leading passage 49. The leading passage 49 includes film apertures 40 and generally as with previous embodiments includes its own ribs or apertures 149*a*, 149*b* to stimulate turbulence within the leading passage 49 for improved flow turbulence and therefore heat transfer.

As illustrated above with regard to FIG. 3 generally the vortices 25*a*, 25*b* will rotate respectively in substantive isolation in separate parts of the passage 22. Furthermore the direction of rotation with regard to the respective vortices

Figure 6:
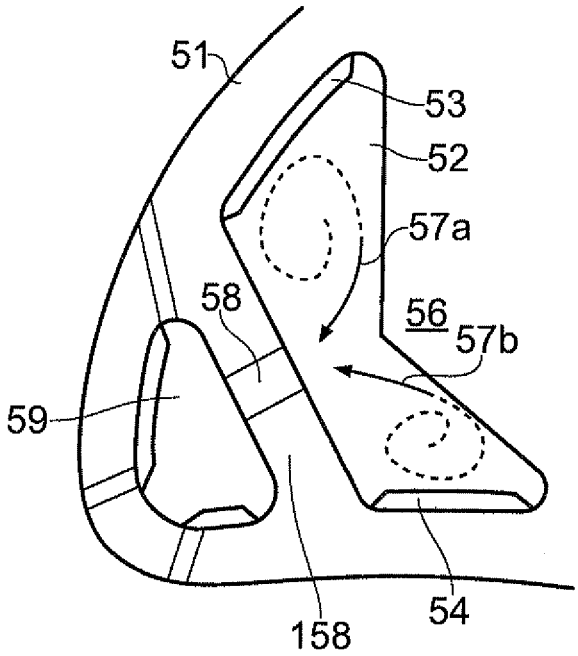
FIG. 6 is a schematic cross section of a third embodiment of aspects of the present invention.

25*a*, 25*b* will be centred within their respective parts of the passage 22 to create side by side portions of the fluid flows in the vortices 25. As illustrated in FIG. 6 and a third embodiment of aspects of the present invention such an approach allows provision of a single impingement orifice 58 in an impingement wall 158 in a hollow blade component 51. Thus as previously a passage 52 includes undulations or ribs 53, 54 to create a lateral aspect to the fluid flow which has a rotating vortex in accordance with aspects of the present invention and by a shaped portion 56 in the wall of the aperture 52 a number of vortices are generated. The shaped portion 56 as described previously will generate respective vortices which will have side by side components depicted by arrowheads 57 with components 57*a*, 57*b* from each vortex. These components 57*a*, 57*b* will be positioned such that they pass through the impingement orifice 58 into the leading passage 59 for cooling effects as described previously. A single impingement orifice 58 may have advantages with regard to creating a greater flow rate for impingement cooling and pressurisation within the passage 59 and may also facilitate easier fabrication and retain structural strength particularly with a narrow leading edge in the hollow blade component 51.

Figure 7:
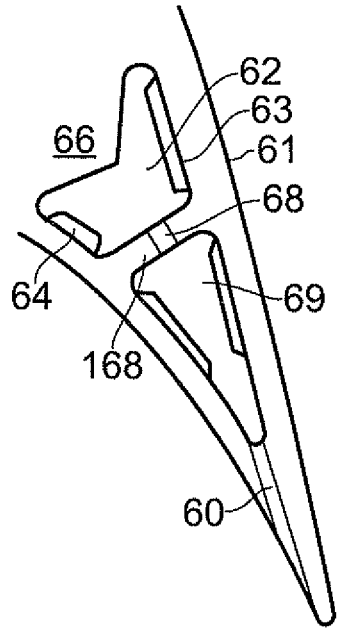
FIG. 7 is a schematic cross section of a fourth embodiment of aspects of the present invention.

Although described previously generally with regard to the leading edge of a hollow blade it will also be understood that aspects of the present invention may be utilised with respect to trailing edges of such blades. In such circumstances as depicted in FIG. 7, aspects of the present invention comprises a hollow blade component 61 in which a passage 62 acts as a feed passage for coolant fluid flow. The passage 62 includes ribs or undulations 63, 64 to generate the lateral vortex flow as described previously and a shaped portion 66 to facilitate vortex creation in respective parts of the passage 62. The vortices (not shown) will then generate enhanced coolant effects as well as greater impingement flow through an impingement orifice 68 in an impingement orifice wall 168 whereby coolant flow into the trailing edge 69 is enhanced again to improve heat transfer and cooling effects within that passage 69. In such circumstances it will be understood that aspects of the present invention can be utilised with regard to a trailing edge of a component 61 as well as a leading edge as described previously.

Figure 8:
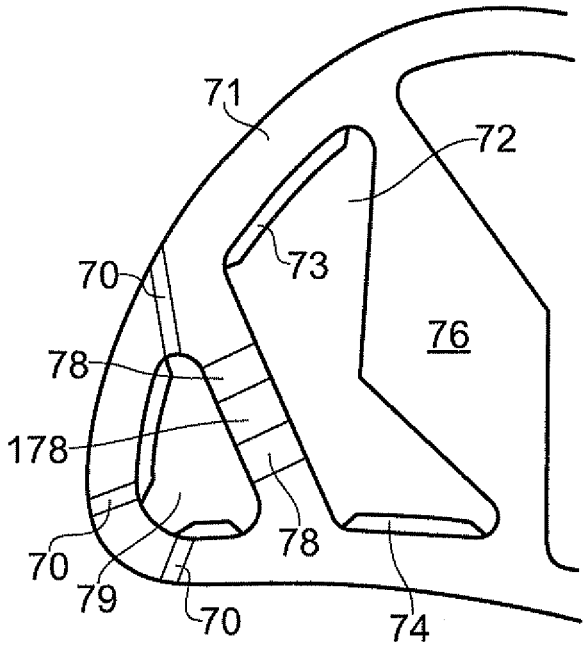
FIG. 8 is a schematic cross section of a fifth embodiment of aspects of the present invention.

FIG. 8 provides a schematic cross section of a leading edge of a hollow blade component 71 including a cooling arrangement in accordance with a fifth aspect of the present invention. Thus, as previously the hollow blade component 71 includes a passage 72 with opposed undulations or ribs 73, 74. In such circumstances again with a fluid flow along the passage 72 lateral flow is stimulated by the undulations 73, 74 in order to generate vortices in respective sides of the passage 72. These vortices enhance flow through impingement apertures 78 in an impingement wall 178 which lead to a leading passage 179 for impingement cooling as well as film development through film apertures 70. In the fifth embodiment depicted in FIG. 8 a shaped portion 76 includes shaping towards the front, that is to say the passage 72 as well as the rear for an internal wall which will enhance fatigue life with respect to the shaped portion 76 and therefore generally longevity with regard to operational service life.

Figure 9:
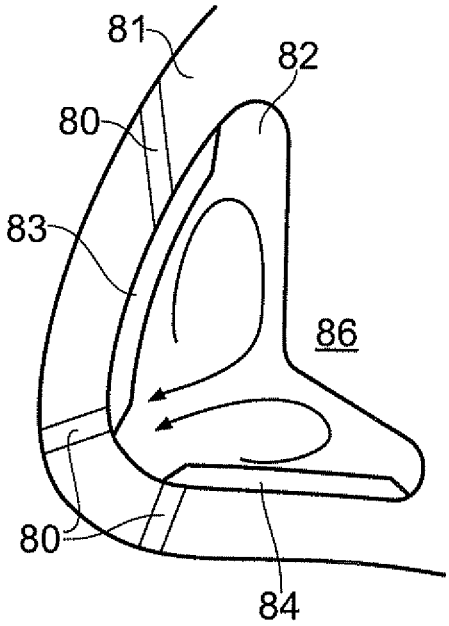
FIG. 9 is a schematic cross section of a sixth embodiment of aspects of the present invention.

FIG. 9 provides a sixth embodiment of aspects of the present invention in which only a single passage is employed. In such circumstances a hollow blade component 81 includes a passage 82 in which opposed undulations or ribs 83, 84 are provided to generate a lateral vortex flow which through a shaped portion 86 substantially between the undulations 83, 84 is further stimulated into providing vortices for enhanced directional flow towards film orifices 80. In such circumstances the strong vortices created by the shaped portion 86 will have a direct effect upon the film developed through the film orifices 80. Undulations/ribs could also be added to shaped portion 86 to further enhance the strength of the vortices.

Figure 10:
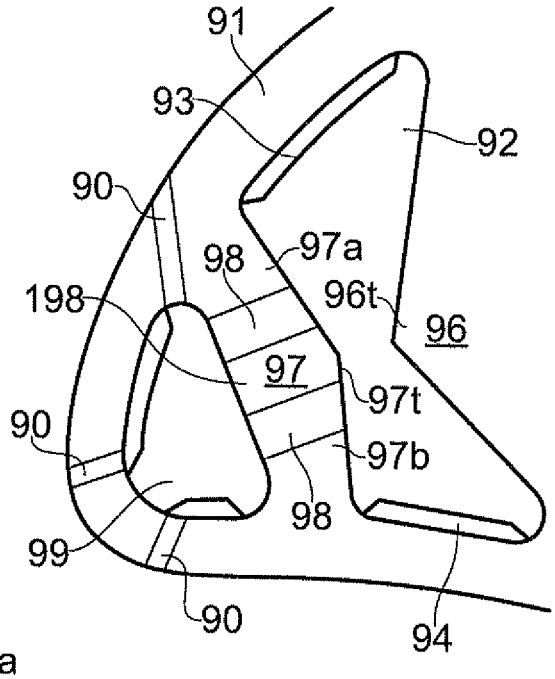
FIG. 10 is a schematic cross section of a seventh embodiment of aspects of the present invention; and, FIG. 11 is a schematic illustration of an eighth embodiment of aspects of the present invention.

FIG. 10 provides a schematic cross section of a seventh embodiment of aspects of the present invention in which again a hollow blade component 91 includes a passage 92 within which opposed undulations or ribs 93, 94 act upon a flow through the passage 92 to create lateral vortex aspects which are enhanced by a shaped portion 96 to define the vortices as described previously. In the seventh embodiment depicted in FIG. 10 a rear surface of the impingement wall 198 is also shaped to enhance and facilitate vortex definition. In such circumstances impingement orifices 98 in the wall portion 198 direct impingement flows towards a leading passage 99. Impingement flows have generally relatively greater force and pressurisation within the leading passage 98 for enhanced heat transfer and cooling effects within the hollow blade component 91. As described previously coolant flow from the leading passage 99 passes through film apertures 90 to develop film cooling effects about the leading edge of the component 91. By providing shaping to both the shaped portion 96 and a rear surface of the wall portion 198 a combination is created with enhanced vortex definition effects from the rotational vortex generated by the opposed undulations or ribs 93, 94.

It will be appreciated that shaping to both the passage wall portions to either side of the proposed undulations or ribs in a passage in accordance with aspects of the present invention has greater enhanced effects with regard to vortex creation. In such circumstances, and as depicted in an eighth embodiment of aspects of the present invention shown in FIG. 11, a hollow blade component 101 with a passage 102 has a shaped portion 106 and opposed undulations 103, 104. The shaped portion 106 has two raised sections which are opposed by reciprocal parts of the rear surface of the impingement wall portion 208. In such circumstances with double shaping as illustrated three vortices 105*a*, 105*b*, 105*c* which by their rotational direction engage mostly respective impingement orifices 108 leading to passage 109. The greater coolant flow pressure in the passage 109 enhances cooling effects and also film development through film orifices 100. The increased number of holes (108) also increases the cooling effectiveness due to the greater surface area covered by the jets.

It will be appreciated from the above that aspects of the present invention utilise and enhance through shaped portions the rotational vortex or lateral vortex flow aspect generated by opposed undulations or ribs in a general feed passage for a hollow blade component. By shaping portions of the passage vortices of a stronger and tighter aspect are generated which can then be utilised to present stronger flows through impingement orifices to a leading passage or directly to film orifices for enhanced cooling effects in comparison with the coolant flow rate utilised. Such relative enhancement of cooling efficiency will provide significant overall benefits with regard to engine operational performance in that greater cooling effect is achieved allowing increased metal reduction temperatures proportionately or higher operating temperatures with less coolant flow.

Aspects of the present invention may be utilised with regard to cooled turbine blades or nozzle guide vanes in a gas turbine engine. These engines may be used in civil, military, marine or industrial applications but by allowing the engine to operate at higher temperatures proportionately to the coolant flow overall operational efficiency is achieved whilst maintaining operational life. As indicated above modifications and alterations to aspects of the present invention may be achieved by a person skilled in the technology. As described the undulations or turbulators in the form of ribs in addition to being in opposed parts of the passage itself may be added to the shaped portions, that is to say the angular walls to increase or optimise the vortex effects and so increase impingement and other cooling effects.

The shaped portions may be angular and have flat planar surfaces for sharper definition of sides to the passage or alternatively as illustrated above may be smoothly shaped to increase and again optimise vortex effects. Similarly, undulations or ribs can be presented and formed in the shaped surfaces where required.

The number of impingement holes, their position and angles may be altered to achieve higher or lower flow rates in portions and sections opposing the impingement holes in the leading passage for relative local cooling effects thereat.

By combining radial and/or tangentially inclined impingement holes the benefits of enhanced vortex control through the shaped portions can be further optimised through flow pickup and direction.

Although of particular benefit with regard to leading edges where high temperature problems persist it will also be understood that cooling arrangements in accordance with aspects of the present invention may be utilised in other regions of a blade or aerofoil such as a trailing edge.

The rear surface of the shaped portion may be angled or shaped to form a diamond or thicker aspect to increase fatigue life for a blade. It will be understood that such an approach may allow aspects of the present invention to be utilised in situations where there is relatively high stresses and therefore predicted shorter operational life than would be acceptable particularly with the impingement holes as described above.

By utilising angled walls in a radial leading passage wall including the impingement orifices it is possible to further increase cooling effectiveness and heat transfer by extending the impingement orifice length and therefore jetting effects with regard to angling as well as enhanced vortex generation within the passage in accordance with aspects of the present invention.

By appropriate multiple shaping and angling of the shaped surfaces in accordance with aspects of the present invention multiple vortexes can be created. These vortexes may be substantially all of the same size or have different sizes and vortex strengths if possible through the shaped portions nevertheless, consideration of potential unbalance within the passage may create instability. Such instability may be detrimental to impingement coolant flow force through the impingement holes in accordance with aspects of the present invention.

As indicated above generally undulations in accordance with aspects of the present invention comprise ribs formed within the passages. Alternatively, there may be surface treatments to alter the flow friction effects and therefore actions which may provide similar flow control effects to ribs or undulations as described above.

In summary of the present invention, an aerofoil of a vane or blade of a gas turbine engine comprises an internal passage through which a cooling fluid passes. The passage is partly formed by first and second opposing walls 27, 26 and as shown in FIGS. 3-11 further defined by the external walls of the aerofoil. The first wall 27 comprises at least one aperture 28 and the second wall 26 comprises angled wall portions 26*a*, 26*b* forming a tip region 26*t* adjacent the first wall. The tip is closest the first wall and the wall portions are divergent away from the first wall. The passage also comprises ribs 23, 24, 33, 34 which together with the wall portions 26*a*, 26*b* create at least two vortices 25*a, b* in the coolant fluid. These vortices rotate such that their direction of rotation forces additional coolant through the apertures to increase the dynamic head of cooling fluid through the aperture. This increases the amount of coolant through the apertures and can improve the impingement cooling of an external wall of the aerofoil.

It should be appreciated that the vortices (e.g. 25*a*, 25*b*) extend across their respective portions (e.g. 35*a*, 35*b*) of the passageway 22. These vortices are rotations of the bulk coolant flow through the passage portions rather than any smaller and local vortices.

In FIG. 3, the first wall comprises two apertures 28, although these can be part of a radially extending array of apertures, and they are arranged either side of the tip region 26*t*. Although, with two counter rotating vortices which can coalesce to pass through just one aperture (or radial array of apertures), in this preferred embodiment each of the vortices feeds coolant into each of which array of apertures.

The ribs are angled relative to a radial line from the engine's rotational axis and as the coolant passes along the passage it is caused, by the angled ribs, to rotate and form the vortices. The vortices are contained within each portion of the passage by the angled walls 26*a* and 26*b* so that stronger vortices are formed. The ribs are preferably formed on the external aerofoil walls 21, however, the ribs a can be arranged on any one or more of the walls depending on preferred vortex strength and aerofoil configuration, such as use in a vane or blade and also the position within the aerofoil and its coolant flow quantities.

The dynamic head of the coolant flow is increased to provide improved impingement cooling via the apertures. This is particularly, desirable for cooling the inner surface of an external wall subject to the very hot working gases passing through a turbine for example. However, in other applications it, may be desirable to increase the dynamic head through apertures to increase the effectiveness of a cooling film over the aerofoil's external surfaces and in this case the first wall 27 is an external wall 81. This is shown in FIG. 9.

Figure 11:
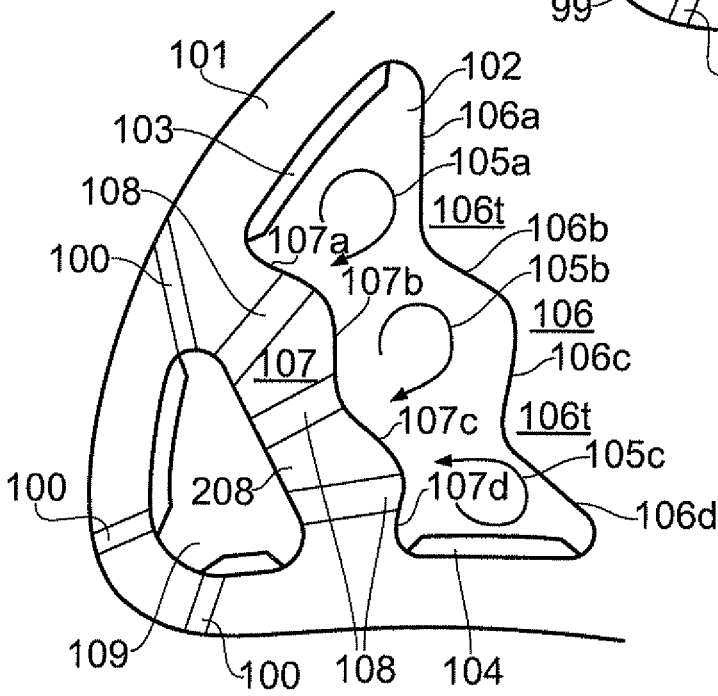

Further detailed improvement can be seen in FIGS. 10 and 11. In FIG. 11, the second wall 106 comprises more than one pair of angled wall portions 106*a, b, c, d* forming a number of tip regions 106*t* positioned adjacent the first wall 107. This arrangement creates three or more vortices 105*a, b, c* in the coolant fluid which are themselves adjacent and feeding corresponding apertures 108 in the first wall 107 to increase the dynamic head of cooling fluid through the aperture.

In FIGS. 10 and 11, the first wall 107, 97 comprises one or more pairs of angled wall portions 97*a, b*, 107*a, b, c, d* which form a number of tip regions 97*t*, 106*t* positioned near to the adjacent the second wall 26. The opposing tip regions 97*t*, 106*t* of the first wall 27 and tip regions 26*t*, 97*t*, 106*t* of the second wall 26 are adjacent one another and help retain and increase the strength of the vortices.

FIG. 5 shows the wall portions 46*a*, 46*b* are concave, but they could be straight or another arcuate form to improve the strength of the vortices.

The invention claimed is:

1. An aerofoil of a gas turbine engine having a rotational axis, the aerofoil comprising an internal passage for a cooling fluid, the passage is partly formed by first and second opposing walls wherein the first wall, comprises at least two apertures, the second wall comprises angled wall portions forming a tip region adjacent the first wall, the passage comprises ribs which together with the wall portions create at least two vortices in the coolant fluid adjacent the apertures to increase the dynamic head of cooling fluid through the apertures, and the apertures are arranged either side of the tip region and into each of which one of the vortices passes coolant fluid with an increased dynamic head.

2. An aerofoil as claimed in claim 1 wherein the aperture(s) is one of an array of apertures, the array of apertures radially extends with respect to the engine's rotational axis.

3. An aerofoil as claimed in claim 1 wherein the ribs are angled relative to a radial line from the engine's rotational axis.

4. An aerofoil as claimed in claim 1 wherein the ribs are arranged on any one or more of the walls forming the passage.

5. An aerofoil as claimed in claim 1 wherein the first wall is an internal wall of the aerofoil and the cooling fluid passing through the apertures is arranged to impinge of an external wall of the aerofoil.

6. An aerofoil as claimed in claim 1 wherein the first wall is an external wall of the aerofoil.

7. An aerofoil as claimed in claim 1 wherein the second wall comprises more than one pair of angled wall portions forming a number of tip regions positioned near to the first wall, which create at three or more vortices in the coolant fluid adjacent and corresponding apertures in the first wall to increase the dynamic head of cooling fluid through the aperture.

8. An aerofoil as claimed in claim 1 wherein the first wall comprises one or more pair of angled wall portions forming a number of tip regions positioned near to the adjacent the second wall.

9. An aerofoil as claimed in claim 1 wherein opposing tip regions of the first wall and tip regions of the second wall are adjacent one another.

10. An aerofoil as claimed in claim 1 wherein the wall portions are straight or arcuate.

11. An aerofoil as claimed in claim 1 wherein the aerofoil is part of a blade or vane.

* * * * *